US006378330B1

(12) United States Patent
Minta et al.

(10) Patent No.: US 6,378,330 B1
(45) Date of Patent: Apr. 30, 2002

(54) PROCESS FOR MAKING PRESSURIZED LIQUEFIED NATURAL GAS FROM PRESSURED NATURAL GAS USING EXPANSION COOLING

(75) Inventors: Moses Minta, Sugar Land; Ronald R. Bowen, Magnolia; John B. Stone, Kingwood, all of TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/731,874

(22) Filed: Dec. 7, 2000

Related U.S. Application Data

(60) Provisional application No. 60/172,548, filed on Dec. 17, 1999.

(51) Int. Cl.[7] ..... F25J 1/00
(52) U.S. Cl. ..... 62/613; 62/619
(58) Field of Search ..... 62/613, 619

(56) References Cited

U.S. PATENT DOCUMENTS

| | | | | |
|---|---|---|---|---|
| 1,574,119 | A | 2/1926 | Seligmann | 62/617 |
| 2,903,858 | A | 9/1959 | Bocquet | 62/11 |
| 3,162,519 | A | 12/1964 | Peters et al. | |
| 3,298,805 | A | 1/1967 | Secord et al. | 48/190 |
| 3,349,571 | A | 10/1967 | Nebgen | 62/619 |
| 3,358,460 | A | 12/1967 | Smith et al. | 62/649 |
| 3,383,873 | A | 5/1968 | Becker | 62/11 |
| 3,433,026 | A | 3/1969 | Swearingen | 62/63 |
| 3,477,509 | A | 11/1969 | Arendt | 166/252 |
| 3,616,652 | A | 11/1971 | Engel | 62/11 |
| 3,677,019 | A | 7/1972 | Olszewski | 62/9 |
| 3,724,226 | A | 4/1973 | Pachaly | 62/39 |
| 3,735,600 | A | 5/1973 | Dowdell et al. | 62/39 |
| 4,147,525 | A | 4/1979 | Bradley | 62/613 |
| 4,157,904 | A | 6/1979 | Campbell et al. | 62/27 |
| 4,315,407 | A | 2/1982 | Creed et al. | 62/53 |
| 4,456,459 | A | 6/1984 | Brundige, Jr. | 62/9 |
| 4,541,852 | A | 9/1985 | Newton et al. | 62/613 |
| 4,548,629 | A | 10/1985 | Chiu | 62/613 |
| 4,563,201 | A | 1/1986 | Brundige, Jr. | 62/11 |
| 4,582,519 | A | 4/1986 | Someya et al. | 62/37 |
| 4,638,639 | A | 1/1987 | Marshall et al. | 62/9 |
| 4,687,499 | A | 8/1987 | Aghili | 62/24 |
| 4,698,081 | A | 10/1987 | Aghili | 62/24 |
| 4,727,723 | A | 3/1988 | Durr | 62/54 |

(List continued on next page.)

FOREIGN PATENT DOCUMENTS

| | | | |
|---|---|---|---|
| GB | 2039352 | 8/1980 | 62/613 |
| WO | WO 97/01069 | 1/1997 | |
| WO | WO 97/13109 | 4/1997 | |

OTHER PUBLICATIONS

Broeker, Roger J.; CNG and MLG –New Natural Gas Transportation Processes, *American Gas Journal*, Jul. 1969.

Bennett, C. P.; Marine Transportation of LNG at Intermediate Temperature, *CME* (Mar. 1979), pp. 63–64.

(List continued on next page.)

*Primary Examiner*—Ronald Capossela
(74) *Attorney, Agent, or Firm*—Gary D. Lawson

(57) ABSTRACT

This invention relates to process for liquefying a pressurized gas stream rich in methane. In a first step of the process, a first fraction of a pressurized feed stream, preferably at a pressure above 11,000 kPa, is withdrawn and entropically expanded to a lower pressure to cool and at least partially liquefy the withdrawn first fraction. A second fraction of the feed stream is cooled by indirect heat exchange with the expanded first fraction. The second fraction is subsequently expanded to a lower pressure, thereby at least partially liquefying the second fraction of the pressurized gas stream. The liquefied second fraction is withdrawn from the process as a pressurized product stream having a temperature above −112° C. and a pressure at or above its bubble point pressure.

24 Claims, 6 Drawing Sheets

U.S. PATENT DOCUMENTS

| | | | | |
|---|---|---|---|---|
| 4,778,497 | A | 10/1988 | Hanson et al. | 62/11 |
| 4,894,076 | A | 1/1990 | Dobracki et al. | 62/9 |
| 5,036,671 | A | 8/1991 | Nelson et al. | 62/23 |
| 5,199,266 | A | 4/1993 | Johansen | 62/8 |
| 5,271,231 | A | 12/1993 | Ha et al. | 62/39 |
| 5,363,655 | A | 11/1994 | Kikkawa et al. | 62/9 |
| 5,473,900 | A | 12/1995 | Low | 62/9 |
| 5,600,969 | A | 2/1997 | Low | 62/622 |
| 5,615,561 | A | 4/1997 | Houshmand et al. | 62/611 |
| 5,651,269 | A | 7/1997 | Prevost et al. | 62/613 |
| 5,669,234 | A | 9/1997 | Houser et al. | 62/612 |
| 5,755,114 | A | 5/1998 | Foglietta | 62/618 |
| 5,768,912 | A | 6/1998 | Dubar | 62/613 |
| 5,799,505 | A | 9/1998 | Bonaquist et al. | 62/613 |
| 5,802,874 | A | 9/1998 | Voit | 62/650 |
| 5,836,173 | A | 11/1998 | Lynch et al. | 62/613 |
| 5,878,814 | A | 3/1999 | Breivik et al. | 166/267 |
| 5,950,453 | A | 9/1999 | Bowen et al. | 62/612 |
| 5,956,971 | A | 9/1999 | Cole et al. | 62/623 |
| 6,016,665 | A | 1/2000 | Cole et al. | 62/612 |
| 6,041,619 | A | 3/2000 | Fischer et al. | 62/612 |
| 6,047,747 | A | 4/2000 | Bowen et al. | 141/231 |
| 6,085,528 | A | 7/2000 | Woodall et al. | 62/45.1 |
| 6,089,028 | A | 7/2000 | Bowen et al. | 62/50.2 |
| 6,209,350 | B1 * | 4/2001 | Kimble, III | 62/613 |
| 6,269,656 | B1 * | 8/2001 | Johnston | 62/613 |

OTHER PUBLICATIONS

Broeker, R. J.; CNG and MLG–New Natural Gas Transportation Process, *American Gas Journal* (Jul. 1969) pp. 138–140.

Faridany, E. K.; Ffooks R. C.; and Meikle, R.B.; A Pressure LNG System, *European Offshore Petroleum Conference & Exhibition* (Oct. 21–24, 1980), vol. Eur. 171, pp. 245–254.

Faridany, E. K., Secord, H. C., O'Brien, J. V., Pritchard, J. F., and Banister, M.; The Ocean Phoenix Pressure–LNG System, *Gastech 76* (1976), New York, pp. 267–280.

Fluggen, Prof. E. and Backhaus, Dr. I. H.; Pressurised LNG–and the Utilisation of Small Gas Fields, *Gas Tech 78*, LNG/LPG Conference (Nov. 7, 1978), Monte Carlo pp. 195–204.

Turboexpanders, Engineering Data Book, *Gas Processor Suppliers Association*. (1987), vol. I, Sec. 1–16, pp. 13–40; 13–41.

Lynch, J. T. and Pitman, R. N.; Improving Throughput and Ethane Recovery at GPM's Goldsmith Gas Plant, Proceeding of the Seventy–Fifth Gas Processors Association Annual Convention, (Mar. 11–13, 1996), Denver, Colorado, pp. 219–217.

Maddox, R. N. Sheerar, L. F., and Erbar, J. H.; Cryogenic Expander Processing, *Gas Conditioning and Processing*, (Jan. 1982) vol. 3, 13–9;13–10.

Perret, J.; Techniques in the Liquefaction of Natural Gas, *French Natural Gas* (Nov. 11, 1996), pp. 1537–1539.

Petsinger, R. E.; LNG on the Move, *GAS*, (Dec. 1967), pp. 45–59.

Broeker, R. J.; A New Process for the Transportation of Natural Gas, *Proceedings of the First International Conference on LNG* (1968), Chicago, Illinois, Session No. 5, paper 30, pp. 1–11.

Lynch, J. T. and Pitman, R. N.; Texas Plant Retrofit Improves Throughput $C_2$, Recovery, *Oil and Gas Journal* (Jun. 3, 1996), pp. 41–48.

Minta, Moses and Smith Jr., Joseph L.; An Entropy Flow Optimization Technique for Helium Liquefaction Cycles, *Advances in Cryogenic Engineering*, vol. 29, (1984), pp. 469–478.

* cited by examiner

PROCESS FOR MAKING PRESSURIZED LIQUEFIED NATURAL GAS FROM PRESSURED NATURAL GAS USING EXPANSION COOLING

This application claims the benefit of U.S. Provisional Application No. 60/172,548 filed Dec. 17, 1999.

FIELD OF THE INVENTION

The invention relates to a process for liquefaction of natural gas and other methane-rich gas streams, and more particularly relates to a process to produce pressurized liquid natural gas (PLNG).

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

In the design of a LNG plant, one of the most important considerations is the process for converting natural gas feed stream into LNG. The most common liquefaction processes use some form of refrigeration system.

LNG refrigeration systems are expensive because so much refrigeration is needed to liquefy natural gas. A typical natural gas stream enters a LNG plant at pressures from about 4,830 kPa (700 psia) to about 7,600 kPa (1,100 psia) and temperatures from about 20° C. (68° F.) to about 40° C. (104° F.). Natural gas, which is predominantly methane, cannot be liquefied by simply increasing the pressure, as is the case with heavier hydrocarbons used for energy purposes. The critical temperature of methane is −82.5° C. (−116.5° F.). This means that methane can only be liquefied below that temperature regardless of the pressure applied. Since natural gas is a mixture of gases, it liquefies over a range of temperatures. The critical temperature of natural gas is between about −85° C. (−121° F.) and −62° C. (−80° F.). Typically, natural gas compositions at atmospheric pressure will liquefy in the temperature range between about −165° C. (−265° F.) and −155° C. (−247° F.). Since refrigeration equipment represents such a significant part of the LNG facility cost, considerable effort has been made to reduce the refrigeration costs and to reduce the weight of the liquefaction process for offshore applications. There is an incentive to keep the weight of liquefaction equipment as low as possible to reduce the structural support requirements for liquefaction plants on such structures.

Although many refrigeration cycles have been used to liquefy natural gas, the three types most commonly used in LNG plants today are: (1) "cascade cycle" which uses multiple single component refrigerants in heat exchangers arranged progressively to reduce the temperature of the gas to a liquefaction temperature, (2) "multi-component refrigeration cycle" which uses a multi-component refrigerant in specially designed exchangers, and (3) "expander cycle" which expands gas from a high pressure to a low pressure with a corresponding reduction in temperature. Most natural gas liquefaction cycles use variations or combinations of these three basic types.

The cascade system generally uses two or more refrigeration loops in which the expanded refrigerant from one stage is used to condense the compressed refrigerant in the next stage. Each successive stage uses a lighter, more volatile refrigerant which, when expanded, provides a lower level of refrigeration and is therefore able to cool to a lower temperature. To diminish the power required by the compressors, each refrigeration cycle is typically divided into several pressure stages (three or four stages is common). The pressure stages have the effect of dividing the work of refrigeration into several temperature steps. Propane, ethane, ethylene, and methane are commonly used refrigerants. Since propane can be condensed at a relatively low pressure by air coolers or water coolers, propane is normally the first-stage refrigerant. Ethane or ethylene can be used as the second-stage refrigerant. Condensing the ethane exiting the ethane compressor requires a low-temperature coolant. Propane provides this low-temperature coolant function. Similarly, if methane is used as a final-stage coolant, ethane is used to condense methane exiting the methane compressor. The propane refrigeration system is therefore used to cool the feed gas and to condense the ethane refrigerant and ethane is used to further cool the feed gas and to condense the methane refrigerant.

A mixed refrigerant system involves the circulation of a multi-component refrigeration stream, usually after precooling to about −35° C. (−31° F.) with propane. A typical multi-component system will comprise methane, ethane, propane, and optionally other light components. Without propane precooling, heavier components such as butanes and pentanes may be included in the multi-component refrigerant. The nature of the mixed refrigerant cycle is such that the heat exchangers in the process must routinely handle the flow of a two-phase refrigerant. This requires the use of large specialized heat exchangers. Mixed refrigerants exhibit the desirable property of condensing over a range of temperatures, which allows the design of heat exchange systems that can be thermodynamically more efficient than pure component refrigerant systems.

The expander system operates on the principle that gas can be compressed to a selected pressure, cooled, typically be external refrigeration, then allowed to expand through an expansion turbine, thereby performing work and reducing the temperature of the gas. It is possible to liquefy a portion of the gas in such an expansion. The low temperature gas is then heat exchanged to effect liquefaction of the feed. The power obtained from the expansion is usually used to supply part of the main compression power used in the refrigeration cycle. The typical expander cycle for making LNG operates at pressures under about 6,895 kPa (1,000 psia). The cooling has been made more efficient by causing the components of the warming stream to undergo a plurality of work expansion steps.

It has been recently proposed to transport natural gas at temperatures above −112° C. (−170° F.) and at pressures sufficient for the liquid to be at or below its bubble point temperature. For most natural gas compositions, the pressure of the natural gas at temperatures above −112° C. will be between about 1,380 kPa (200 psia) and about 4,480 kPa (650 psia). This pressurized liquid natural gas is referred to as PLNG to distinguish it from LNG, which is transported at near atmospheric pressure and at a temperature of about −162° C. (−260° F.). Processes for making PLNG are disclosed in U.S. Pat. No. 5,950,453 by R. R. Bowen et al., U.S. Pat. No. 5,956,971 by E. T. Cole et al., U.S. Pat. No. 6,023,942 by E. R. Thomas et al., and U.S. Pat. No. 6,016,665 by E. T. Cole et al.

U.S. Pat. No. 6,023,942 by E. R. Thomas et al. discloses a process for making PLNG by expanding feed gas stream rich in methane. The feed gas stream is provided with an initial pressure above about 3,100 kPa (450 psia). The gas is liquefied by a suitable expansion means to produce a liquid product having a temperature above about −112° C. (−170° F.) and a pressure sufficient for the liquid product to be at or below its bubble point temperature. Prior to the expansion, the gas can be cooled by recycle vapor that passes through the expansion means without being liquefied. A phase separator separates the PLNG product from gases not liquefied by the expansion means. Although the process of U.S. Pat. No. 6,023,942 can effectively produce PLNG, there is a continuing need in the industry for a more efficient process for producing PLNG.

SUMMARY

This invention discloses a process for liquefying a pressurized gas stream rich in methane. In a first step, a first fraction of a pressurized feed stream, preferably at a pressure above 11,032 kPa (1,600 psia), is withdrawn and entropically expanded to a lower pressure to cool and at least partially liquefy the withdrawn first fraction. A second fraction of the feed stream is cooled by indirect heat exchange with the expanded first fraction. The second fraction is subsequently expanded to a lower pressure, thereby at least partially liquefying the second fraction of the pressurized gas stream. The liquefied second fraction is withdrawn from the process as a pressurized product stream having a temperature above −112° C. (−170° F.) and a pressure at or above its bubble point pressure.

BRIEF DESCRIPTION OF THE DRAWINGS

The present invention and its advantages will be better understood by referring to the following detailed description and the following drawings.

Figure 1:
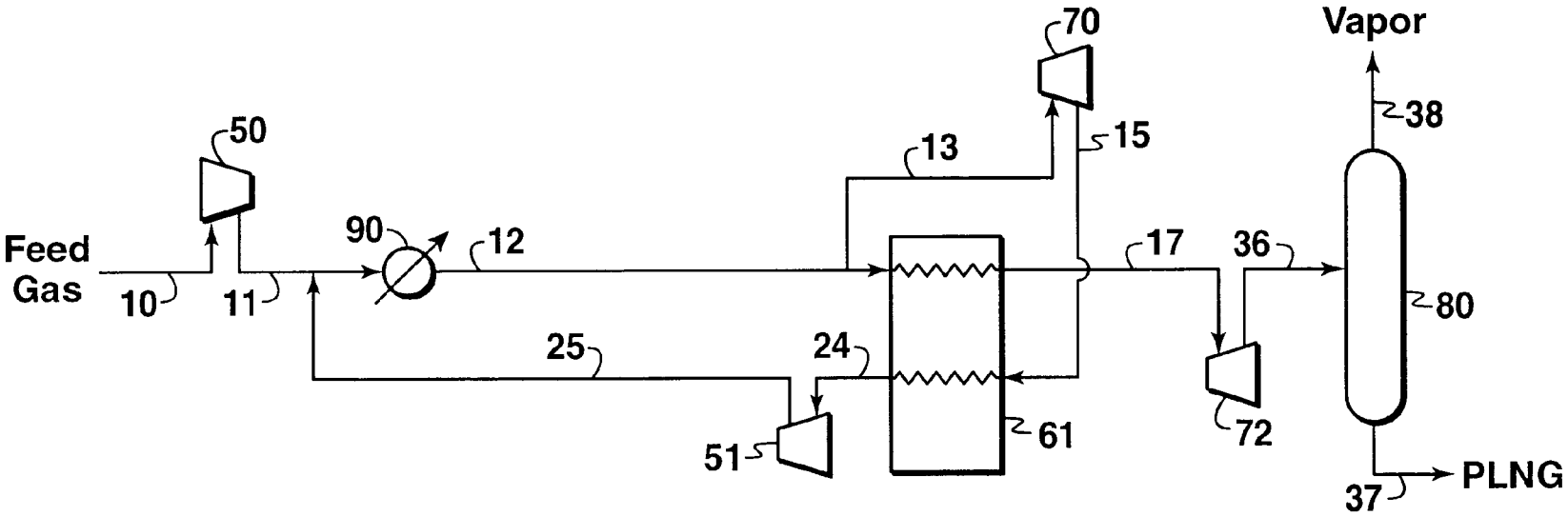
FIG. 1 is a schematic flow diagram of one embodiment for producing PLNG in accordance with the process of this invention.

The drawings illustrate specific embodiments of practicing the process of this invention. The drawings are not intended to exclude from the scope of the invention other embodiments that are the result of normal and expected modifications of the specific embodiments.

DETAILED DESCRIPTION OF THE INVENTION

The present invention is an improved process for liquefying natural gas by pressure expansion to produce a methane-rich liquid product having a temperature above about −112° C. (−170° F.) and a pressure sufficient for the liquid product to be at or below its bubble point. This methane-rich product is sometimes referred to in this description as pressurized liquid natural gas ("PLNG"). In the broadest concept of this invention, one or more fractions of high-pressure, methane-rich gas is expanded to provide cooling of the remaining fraction of the methane-rich gas. In the liquefaction process of the present invention, the natural gas to be liquefied is pressurized to a relatively high pressure, preferably at above 11,032 kPa (1,600 psia). The inventors have discovered that liquefaction of natural gas to produce PLNG can be thermodynamically efficient using open-loop refrigeration at relatively high pressure to provide pre-cooling of the natural gas before its liquefaction by pressure expansion. Before this invention, the prior art has not been able to efficiently make PLNG using open loop refrigeration as the primary pre-cooling process.

The term "bubble point" as used in this description means the temperature and pressure at which a liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point pressure at that temperature. At the bubble point, the liquefied gas is saturated liquid. For most natural gas compositions, the bubble point pressure of the natural gas at temperatures above −112° C. will be above about 1,380 kPa (200 psia). The term natural gas as used in this description means a gaseous feed stock suitable for manufacturing PLNG. The natural gas could comprise gas obtained from a crude oil well (associated gas) or from a gas well (non-associated gas). The composition of natural gas can vary significantly. As used herein, a natural gas stream contains methane ($C_1$) as a major component. The natural gas will typically also contain ethane ($C_2$), higher hydrocarbons ($C_{3+}$), and minor amounts of contaminants such as water, carbon dioxide, hydrogen sulfide, nitrogen, dirt, iron sulfide, wax, and crude oil. The solubilities of these contaminants vary with temperature, pressure, and composition. If the natural gas stream contains heavy hydrocarbons that could freeze out during liquefaction or if the heavy hydrocarbons are not desired in PLNG because of compositional specifications or their value as condensate, the heavy hydrocarbon are typically removed by a separation process such as fractionation prior to liquefaction of the natural gas. At the operating pressures and temperatures of PLNG, moderate amounts of nitrogen in the natural gas can be tolerated since the nitrogen can remain in the liquid phase with the PLNG. Since the bubble point temperature of PLNG at a given pressure decreases with increasing nitrogen content, it will normally be desirable to manufacture PLNG with a relatively low nitrogen concentration.

Referring to FIG. 1, pressurized natural gas feed stream 10 that enters the liquefaction process will typically require further pressurization by one or more stages of compression to obtain a preferred pressure above 11,032 kPa (1,600 psia), and more preferably above 13,800 kPa (2,000 psia). It should be understood, however, that this compression stage would not be required if the feed natural gas is available at a pressure above 12,410 kPa. After each compression stage, the compressed vapor is cooled, preferably by one or more conventional air or water coolers. For ease of illustrating the process of the present invention, FIG. 1 shows only one stage of compression (compressor 50) followed by one cooler (cooler 90).

A major portion of stream 12 is passed through heat exchanger 61. A minor portion of the compressed vapor stream 12 is withdrawn as stream 13 and passed through an expansion means 70 to reduce the pressure and temperature of gas stream 13, thereby producing a cooled stream 15 that is at least partially liquefied gas. Stream 15 is passed through heat exchanger 61 and exits the heat exchanger as stream 24. In passing through the heat exchanger 61, stream 15 cools by indirect heat exchange the pressurized gas stream 12 as it passes through heat exchanger 61 so that the stream 17 exiting heat exchanger 61 is substantially cooler than stream 12.

Stream 24 is compressed by one or more compression stages with cooling after each stage. In FIG. 1, after the gas is pressured by compressor 51, the compressed stream 25 is recycled by being combined with the pressurized feed stream, preferably by being combined with stream 11 upstream of cooler 90.

Stream 17 is passed through an expansion means 72 for reducing pressure of stream 17. The fluid stream 36 exiting the expansion means 72 is preferably passed to one or more phase separators which separate the liquefied natural gas from any gas that was not liquefied by expansion means 72. The operation of such phase separators is well known to those of ordinary skill in the art. The liquefied gas is then passed as product stream 37 having a temperature above −112° C. (−170° F.) and a pressure at or above its bubble point pressure to a suitable storage or transportation means (not shown) and the gas phase from a phase separator (stream 38) may be used as fuel or recycled to the process for liquefaction.

Figure 2:
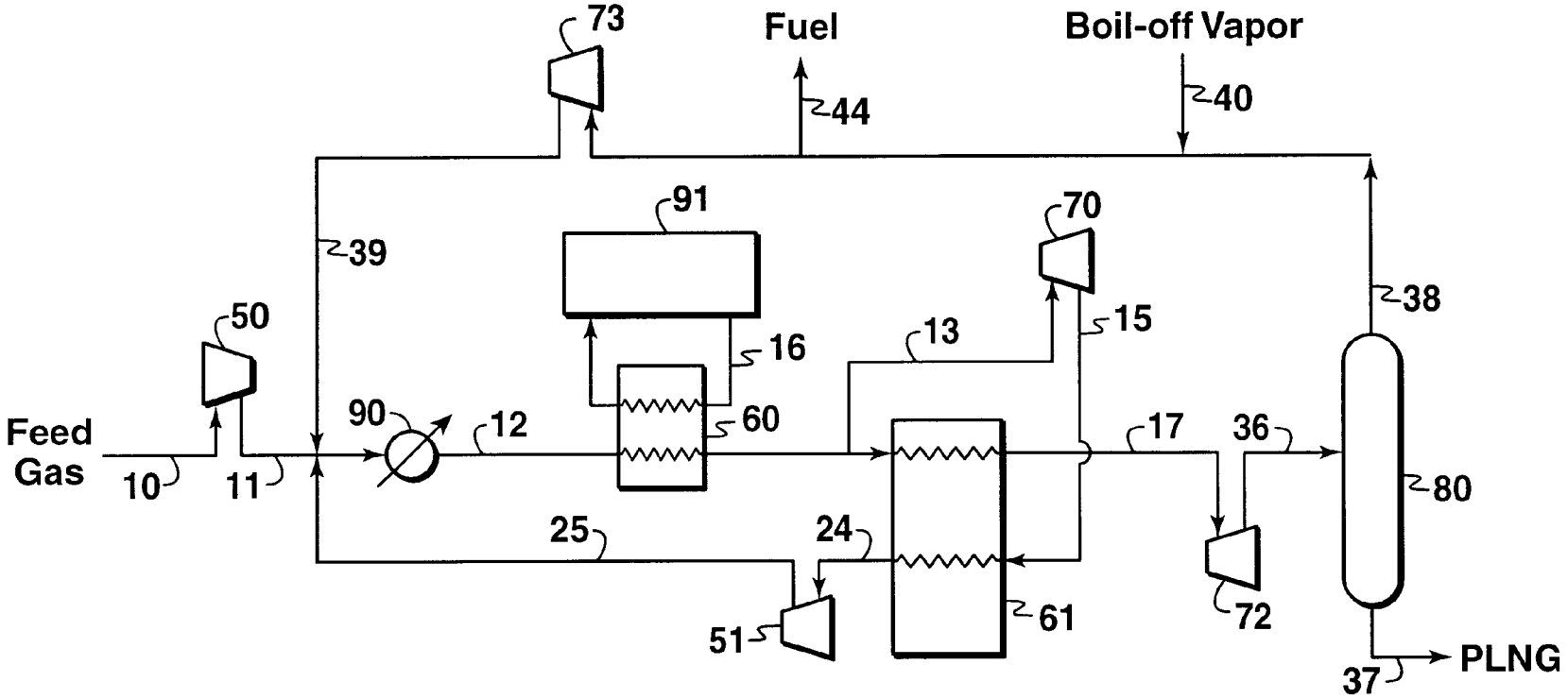
FIG. 2 is a schematic flow diagram of a second embodiment for producing PLNG which is similar to the process shown in FIG. 1 except that external refrigeration is used to pre-cool the incoming gas stream.

FIG. 2 is a diagrammatic illustration of another embodiment of the invention that is similar to the embodiment of FIG. 1 in which the like elements to FIG. 1 have been given like numerals. The principal differences between the process of FIG. 2 and the process of FIG. 1 are that in FIG. 2 process (1) the vapor stream 38 that exits the top of separator 80 is compressed by one or more stages of compression by compression device 73 to approximately the pressure of vapor stream 11 and the compressed stream 39 is combined with feed stream 11 and (2) stream 12 is cooled by indirect heat exchanger against a closed-cycle refrigerant in heat exchanger 60. As stream 12 passes through heat exchanger 60, it is cooled by stream 16 that is connected to a conventional, closed-loop refrigeration system 91. A single, multi-component, or cascade refrigeration system 91 may be used. A cascade refrigeration system could comprise at least two closed-loop refrigeration cycles. The closed-loop refrigeration cycles may use, for example and not as a limitation on the present invention, refrigerants such as methane, ethane, propane, butane, pentane, carbon dioxide, hydrogen sulfide, and nitrogen. Preferably, the closed-loop refrigeration system 91 uses propane as the predominant refrigerant. A boil-off vapor stream 40 may optionally be introduced to the liquefaction process to reliquefy boil-off vapor produced from PLNG. FIG. 2 also shows a fuel stream 44 that may be optionally withdrawn from vapor stream 38.

Figure 3:
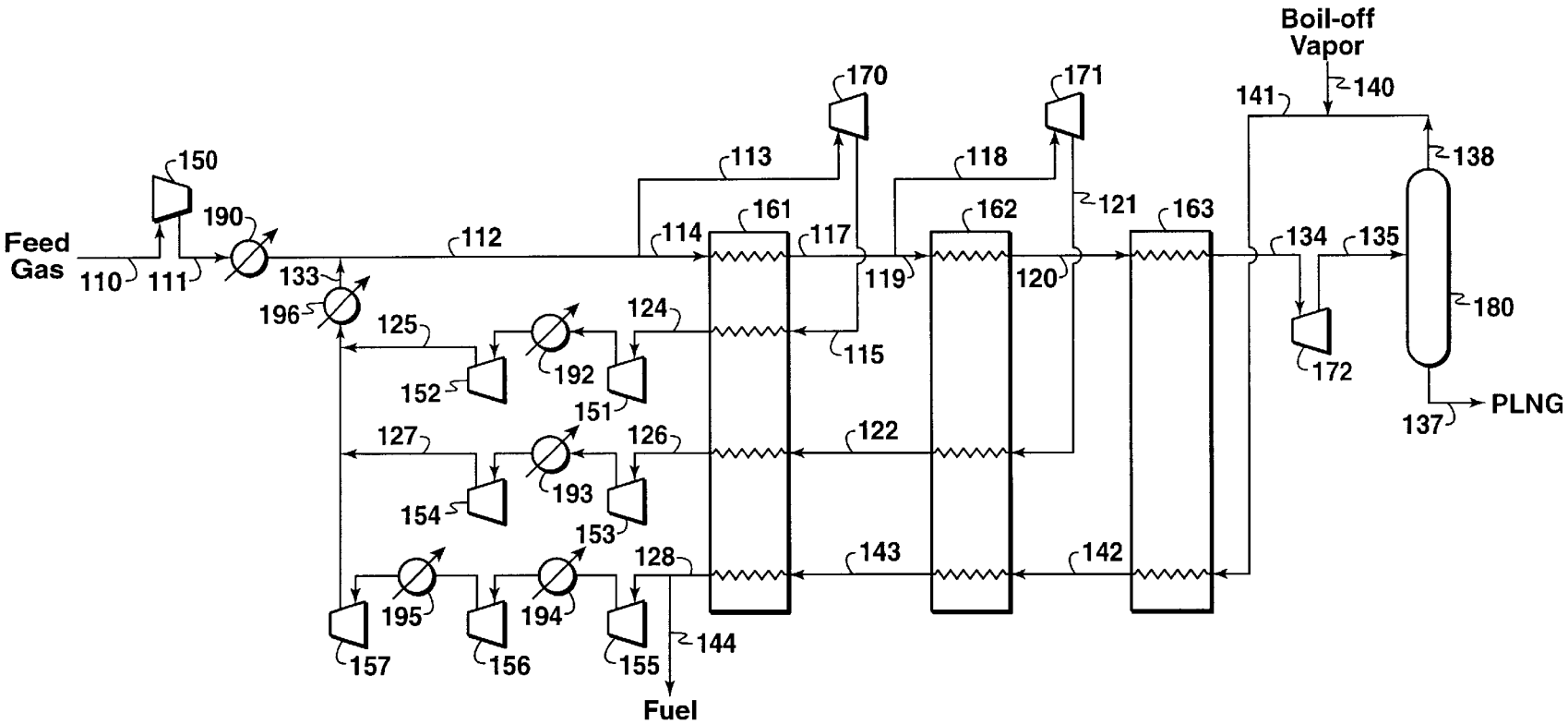
FIG. 3 is a schematic flow diagram of a third embodiment for producing PLNG in accordance with the process of this invention which uses three expansion stages and three heat exchangers for cooling the gas to PLNG conditions.

FIG. 3 shows a schematic flow diagram of a third embodiment for producing PLNG in accordance with the process of this invention which uses three expansion stages and three heat exchangers for cooling the gas to PLNG conditions. In this embodiment, a feed stream 110 is compressed by one or more compression stages with one or more after-coolers after each compression stage. For simplicity, FIG. 3 shows one compressor 150 and one after-cooler 190. A major portion of the high pressure stream 112 is passed through a series of three heat exchangers 161, 162, and 163 before the cooled stream 134 is expanded by expansion means 172 and passed into a conventional phase separator 180. The three heat exchangers are 161, 162, and 163 are each cooled by open-loop refrigeration with none of the cooling effected by closed-loop refrigeration. A minor fraction of the stream 112 is withdrawn as stream 113 (leaving stream 114 to enter heat exchanger 161). Stream 113 is passed through a conventional expansion means 170 to produce expanded stream 115, which is then passed through heat exchanger 161 to provide refrigeration duty for cooling stream 114. Stream 115 exits the heat exchanger 161 as stream 124 and it is then passed through one or more stages of compression, with two compression stages shown in FIG. 3 compressors 151 and 152 with conventional after-coolers 192 and 196.

A fraction of the stream 117 exiting heat exchanger 161 is withdrawn as stream 118 (leaving stream 119 to enter heat exchanger 162) and stream 118 is expanded by an expansion means 171. The expanded stream 121 exiting expansion means 171 is passed through heat exchangers 162 and 161 and one or more stages of compression. Two compression stages are shown in FIG. 3 using compressors 153 and 154 with after-cooling in conventional coolers 193 and 196.

In the embodiment shown in FIG. 3, the overhead vapor stream 138 exiting the phase separator 180 is also used to provide cooling to heat exchangers 163, 162, and 161.

In the storage, transportation, and handling of liquefied natural gas, there can be a considerable amount of what is commonly referred to as "boil-off," the vapors resulting from evaporation of liquefied natural gas. The process of this invention can optionally re-liquefy boil-off vapor that is rich in methane. Referring to FIG. 3, boil-off vapor stream 140 is preferably combined with vapor stream 138 prior to passing through heat exchanger 163. Depending on the pressure of the boil-off vapor, the boil-off vapor may need to be pressure adjusted by one or more compressors or expanders (not shown in the Figures) to match the pressure at the point the boil-off vapor enters the liquefaction process.

Vapor stream 141, which is a combination of streams 138 and 140, is passed through heat exchanger 163 to provide cooling for stream 120. From heat exchanger 163 the heated vapor stream (stream 142) is passed through heat exchanger 162 where the vapor is further heated and then passed as stream 143 through heat exchanger 161. After exiting heat exchanger 161, a portion of stream 128 may be withdrawn from the liquefaction process as fuel (stream 144). The remaining portion of stream 128 is passed through compressors 155, 156, and 157 with after-cooling after each stage by coolers 194, 195, and 196. Although cooler 196 is shown as being a separate cooler from cooler 190, cooler 196 could be eliminated from the process by directing stream 133 to stream 111 upstream of cooler 190.

Figure 4:
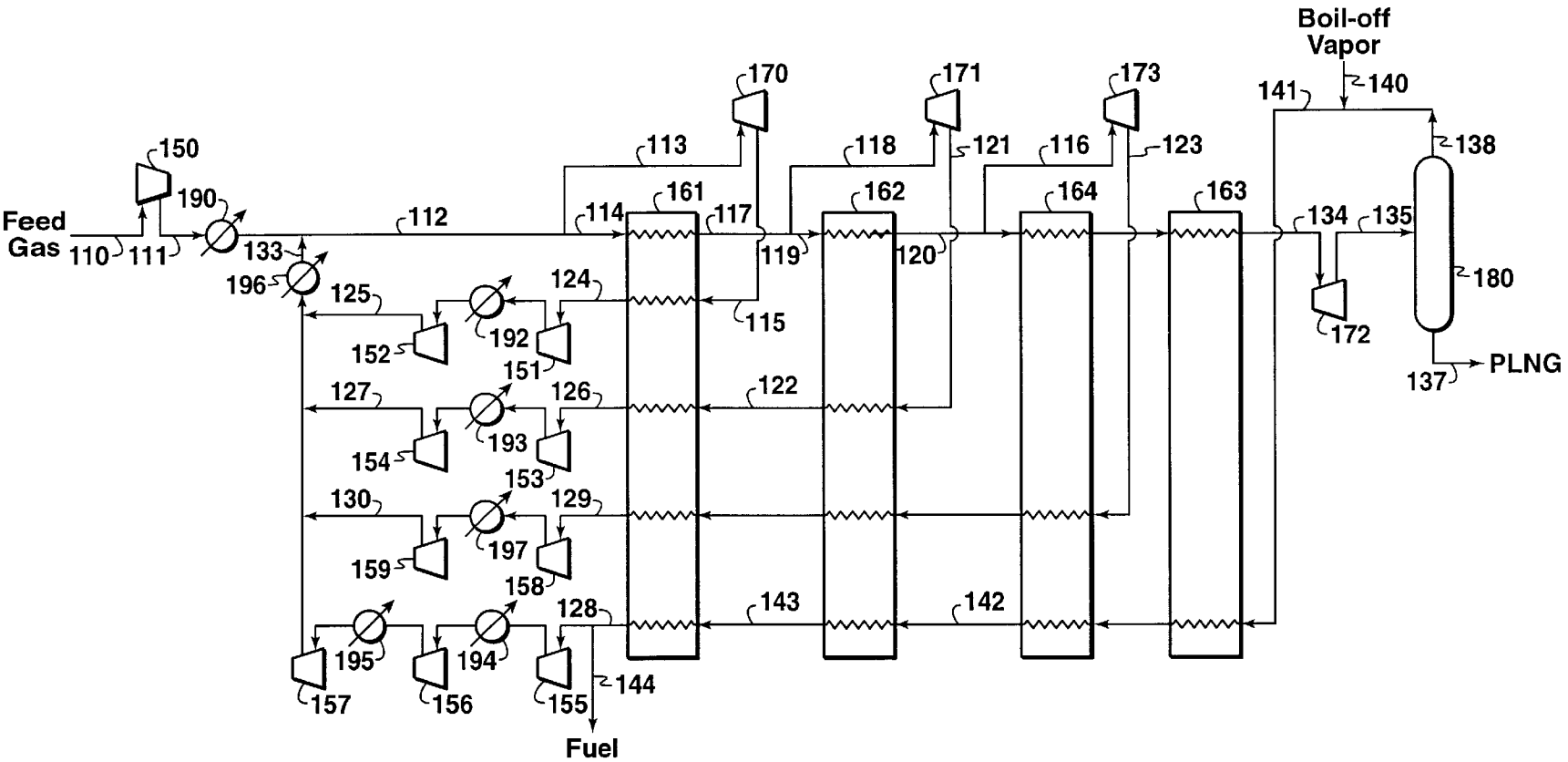
FIG. 4 is a schematic flow diagram of a fourth embodiment for producing PLNG in accordance with the process of this invention which uses four expansion stages and four heat exchangers for cooling the gas to PLNG conditions.

FIG. 4 illustrates a schematic diagram of another embodiment of the present invention in which the like elements to FIG. 3 have been given like numerals. In the embodiment shown in FIG. 4, three expansion cycles using expansion devices 170, 171, and 173 and four heat exchangers 161, 162, 163, and 164 pre-cool the a natural gas feed stream 100 before it is liquefied by expansion device 172. The embodiment of FIG. 4 has a process configuration similar to that illustrated in FIG. 3 except for an added expansion cycle. Referring to FIG. 4, a fraction of stream 120 is withdrawn as stream 116 and pressure expanded by expansion device 173 to a lower pressure stream 123. Stream 123 is then passed in succession through heat exchangers 164, 162, and 161. Stream 129 exiting heat exchanger 161 is compressed and cooled by compressors 158 and 159 and after-coolers 197 and 196.

Figure 5:
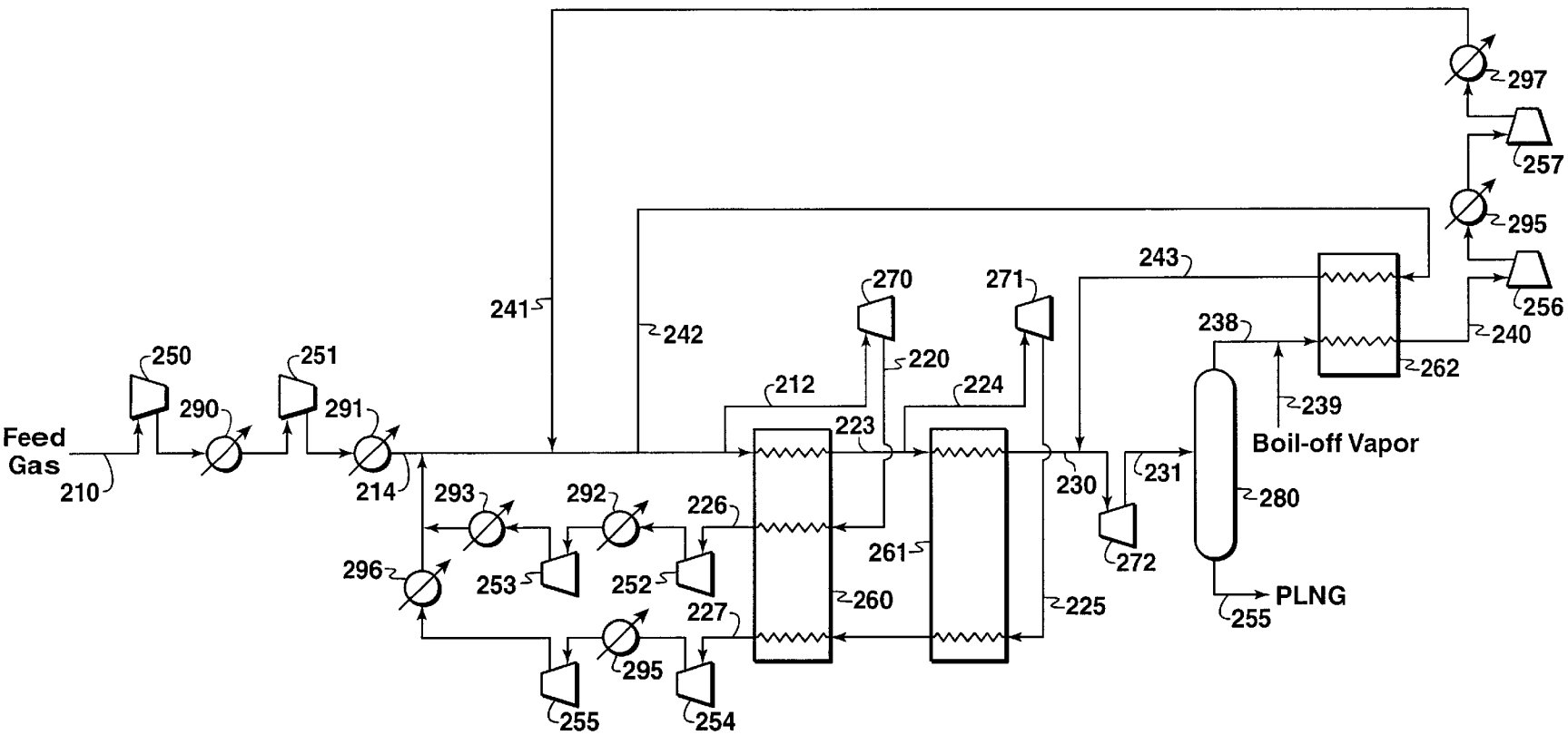
FIG. 5 is a schematic flow diagram of a fifth embodiment for producing PLNG in accordance with the process of this invention.

FIG. 5 shows a schematic flow diagram of a fourth embodiment for producing PLNG in accordance with the process of this invention that uses three expansion stages and three heat exchangers but in a different configuration from the embodiment shown in FIG. 3. Referring to FIG., a stream 210 is passed through compressors 250 and 251 with after cooling in conventional after-coolers 290 and 291. The major fraction of stream 214 exiting after-cooler 291 is passed through heat exchanger 260. A first minor fraction of stream 214 is withdrawn as stream 242 and passed through heat exchanger 262. A second minor fraction of stream 214 is withdrawn as stream 212 and passed through a conventional expansion means 270. An expanded stream 220 exiting expansion means 270 is passed through heat exchanger 260 to provide part of the cooling for the major fraction of stream 214 that passes through heat exchanger 260. After exiting heat exchanger 260, the heated stream 226 is compressed by compressors 252 and 253 with after-cooling by conventional after-coolers 292 and 293. A fraction of stream 223 exiting heat exchanger 260 is withdrawn as stream 224 and passed through an expansion means 271. The expanded stream 225 exiting expansion means 271 is passed through heat exchangers 261 and 260 to also provide additional cooling duty for the heat exchangers 260 and 261. After exiting heat exchanger 260, the heated stream 227 is compressed by compressors 254 and 255 with after-cooling by conventional after-coolers 295 and 296. Streams 226 and 227, after compression to approximately the pressure of stream 214 and suitable after-cooling, are recycled by being combined with stream 214. Although FIG. 5 shows the last stages of the after-cooling of streams 226 and 227 being performed in after-coolers 293 and 296, those skilled in the art would recognize that after-coolers 293 and 296 could be replaced by one or more after-coolers 291 if streams 226 and 227 are introduced to the pressurized vapor stream 210 upstream of cooler 291.

After exiting heat exchanger 261, stream 230 is passed through expansion means 272 and the expanded stream is introduced as stream 231 into a conventional phase separator 280. PLNG is removed as stream 255 from the lower end of the phase separator 280 at a temperature above −112° C. and a pressure sufficient for the liquid to be at or below its bubble point. If expansion means 272 does not liquefy all of stream 230, vapor will be removed as stream 238 from the top of phase separator 280.

Boil-off vapor may optionally be introduced to the liquefaction system by introducing a boil-off vapor stream 239 to vapor stream 238 prior to its passing through heat exchanger 262. The boil-off vapor stream 239 should be at or near the pressure of the vapor stream 238 to which it is introduced.

Vapor stream 238 is passed through heat exchanger 262 to provide cooling for stream 242 which passes through heat exchanger 262. From heat exchanger 262, heated stream 240 is compressed by compressors 256 and 257 with after-cooling by conventional after-coolers 295 and 297 before being combined with stream 214 for recycling.

The efficiency of the liquefaction process of this invention is related to how closely the enthalpy/temperature warming curve of the composite cooling stream, of the entropically expanded high pressure gas, is able to approach the corresponding cooling curve of the gas to be liquefied. The "match" between these two curves will determine how well the expanded gas stream provides refrigeration duty for the liquefaction process. There are, however, certain practical considerations which apply to this match. For example, it is desirable to avoid temperature "pinches" (excessively small differences in temperature) in the heat exchangers between the cooling and warming streams. Such pinches require prohibitively large amounts of heat transfer area to achieve the desired heat transfer. In addition, very large temperature differences are to be avoided since energy losses in heat exchangers are dependent on the temperature differences of the heat exchanging fluids. Large energy losses are in turn associated with heat exchanger irreversibilities or inefficiencies which waste refrigeration potential of the near-isentropically expanded gas.

The discharge pressures of the expansion means (expansion means 70 in FIGS. 1 and 2; expansion means 170 and 171 in FIG. 3; expansion means 170, 171, and 173 in FIG. 4; and expansion means 270 and 271 in FIG. 3) are controlled as closely as possible to substantially match the cooling and warming curves. A good adaptation of the warming and cooling curves of the expanded gases to the natural gas can be attained in the heat exchangers by the practice of the present invention, so that the heat exchange can be accomplished with relatively small temperature differences and thus energy-conserving operation. Referring to FIG. 3, for example, the output pressure of expansion means 170 and 171 are controlled to produce pressures in streams 115 and 121 to ensure substantially matching, parallel cooling/warming curves for heat exchangers 161 and 162. The inventors have discovered that high thermodynamic efficiencies of the present invention for making PLNG result from pre-cooling the pressurized gas to be liquefied at relatively high pressure and having the discharge pressure of the expanded fluid at a significantly higher pressure than expanded fluids used in the past. In the present invention, discharge pressure of the expansion means (for example, expansion means 170 and 171 in FIG. 3) used to pre-cool fractions of the pressurized gas will exceed 1,380 kPa (200 psia), and more preferably will exceed 2,400 kPa (350 psia). Referring to the process shown in FIG. 3, the process of the present invention is thermodynamically more efficient than conventional natural gas liquefaction techniques that typically operate at pressures under 6,895 kPa (1,000 psia) because the present invention provides (1) better matching of the cooling curves, which can be obtained by independently adjusting the pressure of the expanded gas streams 115 and 121 to ensure closely matching, parallel cooling curves for fluids in heat exchangers 161 and 162, (2) improved heat transfer between fluids in the heat exchangers 161 and 162 due to elevated pressure of all streams in the heat exchangers, and (3) reduced process compression horsepower due to lower pressure ratio between the natural gas feed stream 114 and the pressure of the expanded gas streams (recycle streams 124, 126, and 128) and the reduced flow rate of the expanded gas streams.

In designing a liquefaction plant that implements the process of this invention, the number of discrete expansion stages will depend on technical and economic considerations, taking into account the inlet feed pressure, the product pressure, equipment costs, available cooling medium and its temperature. Increasing the number of stages improves thermodynamic performance but increases equipment cost. Persons skilled in the art could perform such optimizations in light of the teachings of this description.

This invention is not limited to any type of heat exchanger, but because of economics, plate-fin and spiral wound heat exchangers in a cold box are preferred, which all cool by indirect heat exchange. The term "indirect heat exchange," as used in this description and claims, means the bringing of two fluid streams into heat exchange relation without any physical contact or intermixing of the fluids with each other. Preferably all streams containing both liquid and vapor phases that are sent to heat exchangers have both the liquid and vapor phases equally distributed across the cross section area of the passages they enter. To accomplish this, distribution apparati can be provided by those skilled in the art for individual vapor and liquid streams. Separators (not shown in the drawings) can be added to the multi-phase flow streams 15 in FIGS. 1 and 2 as required to divide the streams into liquid and vapor streams. Similarly, separators (also not shown) can be added to the multi-phase flow stream 121 of FIG. 3 and stream 225 of FIG. 4.

In FIGS. 1–5, the expansion means 72, 172, and 272 can be any pressure reduction device or devices suitable for controlling flow and/or reducing pressure in the line and can be, for instance, in the form of a turboexpander, a Joule-Thomson valve, or a combination of both, such as, for example, a Joule-Thomson valve and a turboexpander in parallel, which provides the capability of using either or both the Joule-Thomson valve and the turboexpander simultaneously.

Expansion means 70, 170, 171, 173, 270, and 271 as shown in FIGS. 1–5 are preferably in the form of turboexpanders, rather than Joule-Thomson valves, to improve overall thermodynamic efficiency. The expanders used in the present invention may be shaft-coupled to suitable compressors, pumps, or generators, enabling the work extracted from the expanders to be converted into usable mechanical and/or electrical energy, thereby resulting in a considerable energy saving to the overall system.

EXAMPLE

A hypothetical mass and energy balance was carried out to illustrate the embodiment shown in FIG. 3, and the results are shown in the Table below. The data were obtained using a commercially available process simulation program called HYSYSTM (available from Hyprotech Ltd. of Calgary, Canada); however, other commercially available process simulation programs can be used to develop the data, including for example HYSIM™, PROII™, and ASPEN PLUS™, which are familiar to those of ordinary skill in the art. The data presented in the Table are offered to provide a better understanding of the embodiment shown in FIG. 3, but the invention is not to be construed as unnecessarily limited thereto. The temperatures, pressures, compositions, and flow rates can have many variations in view of the teachings herein. This example assumed the natural gas feed stream 10 had the following composition in mole percent: $C_1$:94.3%; $C_2$:3.9%; $C_3$:0.3%; $C_4$:1.1%; $C_5$:0.4%.

Figure 6:
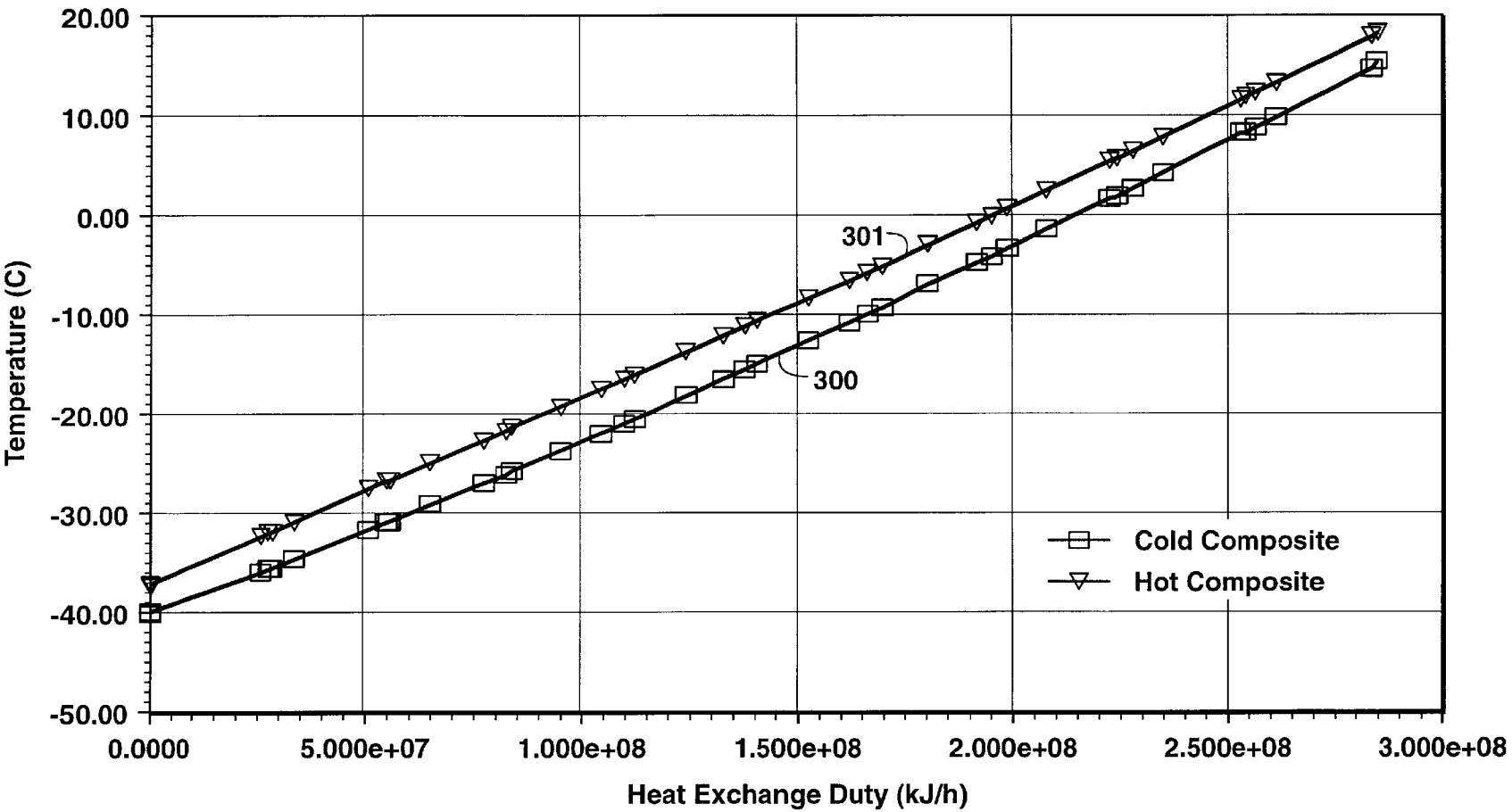
FIG. 6 is a graph of cooling and warming curves for a natural gas liquefaction plant of the type illustrated schematically in FIG. 3, which operates at high pressure.

FIG. 6 is a graph of cooling and warming curves for a natural gas liquefaction plant of the type illustrated schematically in FIG. 3. Curve 300 represents the warming curve of a composite stream consisting of the expanded gas streams 115, 122 and 143 in heat exchanger 161 and curve 301 represents the cooling curve of the natural gas (stream 114) as it passes through these heat exchanger 161. Curves 300 and 301 are relatively parallel and the temperature differences between the curves are about 2.8° C. (5° F.).

A person skilled in the art, particularly one having the benefit of the teachings of this patent, will recognize many modifications and variations to the specific embodiment disclosed above. For example, a variety of temperatures and pressures may be used in accordance with the invention, depending on the overall design of the system and the composition of the feed gas. Also, the feed gas cooling train may be supplemented or reconfigured depending on the overall design requirements to achieve optimum and efficient heat exchange requirements. Additionally, certain process steps may be accomplished by adding devices that are interchangeable with the devices shown. As discussed above, the specifically disclosed embodiment and example should not be used to limit or restrict the scope of the invention, which is to be determined by the claims below and their equivalents.

TABLE

| Stream | Temperature | | Pressure | | Flowrate | |
|---|---|---|---|---|---|---|
| # | Deg C. | deg F. | kPa | psia | kgmol/hr | mmscfd |
| 110 | 26.7 | 80 | 5516 | 800 | 36360 | 730 |
| 112 | 18.3 | 65 | 20684 | 3000 | 36360 | 730 |
| 113 | 18.3 | 65 | 20684 | 3000 | 45973 | 923 |
| 114 | 18.3 | 65 | 20684 | 3000 | 69832 | 1402 |
| 115 | −40.0 | −40 | 7033 | 1020 | 45973 | 923 |
| 117 | −37.2 | −35 | 20643 | 2994 | 69832 | 1402 |
| 118 | −37.2 | −35 | 20643 | 2994 | 21866 | 439 |
| 119 | −37.2 | −35 | 20643 | 2994 | 47966 | 963 |
| 120 | −56.7 | −70 | 20615 | 2990 | 47966 | 963 |
| 121 | −59.4 | −75 | 8584 | 1245 | 21866 | 439 |
| 122 | −40.0 | −40 | 8570 | 1243 | 21866 | 439 |
| 124 | 15.6 | 60 | 7019 | 1018 | 45973 | 923 |
| 126 | 15.6 | 60 | 8556 | 1241 | 21866 | 439 |
| 128 | 15.6 | 60 | 2820 | 409 | 13149 | 264 |
| 133 | 18.3 | 65 | 20684 | 3000 | 79495 | 1596 |
| 134 | −63.9 | −83 | 20608 | 2989 | 47966 | 963 |
| 135 | −95.0 | −139 | 2861 | 415 | 47966 | 963 |
| 137 | −95.0 | −139 | 2861 | 415 | 37805 | 759 |
| 138 | −95.0 | −139 | 2861 | 415 | 10161 | 204 |
| 140 | −90.0 | −130 | 2861 | 415 | 2989 | 60 |
| 141 | −93.9 | −137 | 2861 | 415 | 13149 | 264 |
| 142 | −59.4 | −75 | 2848 | 413 | 13149 | 264 |
| 143 | −40.0 | −40 | 2834 | 411 | 13149 | 264 |
| 144 | 15.6 | 60 | 2820 | 409 | 1494 | 30 |

What is claimed is:

1. A process for liquefying a pressurized gas stream rich in methane, which comprises the steps of:

(a) withdrawing a first fraction of the pressured gas stream and entropically expanding the withdrawn first fraction to a lower pressure to cool and at least partially liquefy the withdrawn first fraction;

(b) cooling a second fraction of the pressurized gas stream by indirect heat exchange with the expanded first fraction;

(c) expanding the second fraction of the pressurized gas stream to a lower pressure, thereby at least partially liquefying the second fraction of the pressurized gas stream; and (d) removing the liquefied second fraction from the process as a pressurized product stream having a temperature above −112° C. (−170° F.) and a pressure at or above its bubble point pressure.

2. The process of claim 1 wherein the pressurized gas stream has a pressure above 11,032 kPa (1,600 psia).

3. The process of claim 1 wherein the cooling of the second fraction against the first fraction is in one or more heat exchangers.

4. The process of claim 1 wherein further comprising before step (a) the additional steps of withdrawing a fraction of the pressured gas stream and entropically expanding the withdrawn fraction to a lower pressure to cool the withdrawn fraction and cooling the remaining fraction of the pressurized gas stream by indirect heat exchange with the expanded fraction.

5. The process of claim 4 wherein the steps of withdrawing and expanding a fraction of the pressurized gas stream are repeated in two separate, sequential stages before step (a) of claim 1.

6. The process of claim 5 wherein the first stage of indirect cooling of the second fraction is in a first heat exchanger and the second stage of indirect cooling of the second fraction is in a second heat exchanger.

7. The process of claim 1 further comprises, after the expanded first fraction cools the second fraction, the additional steps of compressing and cooling the expanded first fraction, and thereafter recycling the compressed first fraction by combining it with the pressurized gas stream at a point in the process before step (b).

8. The process of claim 1 further comprising the step of passing the expanded second fraction of step (c) to a phase separator to produce a vapor phase and a liquid phase, said liquid phase being the product stream of step (d).

9. The process of claim 1 wherein the pressure of the expanded first fraction exceeds 1,380 kPa (200 psia).

10. The process of claim 1 further comprising the additional steps of controlling the pressure of the expanded first fraction to obtain substantial matching of the warming curve of expanded first fraction and the cooling curve of the second fraction as the expanded first fraction cools by indirect heat exchange the second fraction.

11. The process of claim 1 wherein substantially all of cooling and liquefaction of the pressurized gas is by at least two work expansions of the pressurized gas.

12. The process of claim 1 further comprising, before step (a), the additional step of pre-cooling the pressurized gas stream against a refrigerant of a closed-loop refrigeration system.

13. The process of claim 12 wherein the refrigerant is propane.

14. A process for liquefying a pressurized gas stream rich in methane, which comprises the steps of:

(a) withdrawing a first fraction of the pressurized gas stream and expanding the withdrawn first fraction to a lower pressure to cool the withdrawn first fraction;

(b) cooling a second fraction of the pressurized gas stream in a first heat exchanger by indirect heat exchange against the expanded first fraction;

(c) withdrawing from the second fraction a third fraction, thereby leaving a fourth fraction of the pressurized gas stream, and expanding the withdrawn third fraction to a lower pressure to cool and at least partially liquefy the withdrawn third fraction;

(d) cooling the fourth fraction of the pressurized gas stream in a second heat exchanger by indirect heat exchange with the at least partially-liquefied third fraction;

(e) further cooling the fourth fraction of step (d) in a third heat exchanger;

(f) pressure expanding the fourth fraction to a lower pressure, thereby at least partially liquefying the fourth fraction of the pressurized gas stream;

(g) passing the expanded fourth fraction of step (f) to a phase separator which separates vapor produced by the expansion of step (f) from liquid produced by such expansion;

(h) removing vapor from the phase separator and passing the vapor in succession through the third heat exchanger, the second heat exchanger and the first heat exchanger;

(i) compressing and cooling the vapor exiting the first heat exchanger and returning the compressed, cooled vapor to the pressurized stream for recycling; and (j) removing from the phase separator the liquefied fourth fraction as a pressurized product stream having a temperature above −112° C. (−170° F.) and a pressure at or above its bubble point pressure.

15. The process of claim 14 wherein the process further comprises the step of introducing boil-off vapor to the vapor stream removed from the phase separator before the vapor stream is passed through the third heat exchanger.

16. The process of claim 14 further comprises, after the expanded first fraction cools the second fraction, the additional steps of compressing and cooling the expanded first fraction, and thereafter recycling the compressed first fraction by combining it with the pressurized gas stream at a point in the process before step (b).

17. The process of claim 14 wherein the process further comprises, after the third fraction is passed through the second heat exchanger, the additional steps of passing the third fraction through the first heat exchanger, thereafter compressing and cooling the third fraction, and introducing the compressed and cooled third fraction to the pressurized gas stream for recycling.

18. The process of claim 14 wherein the pressurized gas stream has a pressure above 11,032 kPa (1,600 psia).

19. A process for liquefying a pressurized gas stream rich in methane, which comprises the steps of:

(a) withdrawing from the pressured gas stream a first fraction and passing the withdrawn first fraction through a first heat exchanger to cool the first fraction;

(b) withdrawing from the pressured gas stream a second fraction, thereby leaving a third fraction of the pressurized gas stream, and expanding the withdrawn second fraction to a lower pressure to cool the withdrawn second fraction;

(c) cooling the third fraction of the pressurized gas stream in a second heat exchanger by indirect heat exchange with the cooled second fraction;

(d) withdrawing from the cooled third fraction a fourth fraction, thereby leaving a fifth fraction of the pressurized gas stream, and expanding the withdrawn fourth fraction to a lower pressure to cool and at least partially liquefy the withdrawn fourth fraction;

(e) cooling the fifth fraction of the pressurized gas stream in a third heat exchanger by indirect heat exchange with the expanded fourth fraction;

(f) pressure expanding the cooled first fraction and the cooled fifth fraction to a lower pressure, thereby at least partially liquefying the cooled first fraction and the cooled fifth fraction, and passing the expanded first and fifth fractions to a phase separator which separates vapor produced by such expansion from liquid produced by such expansion;

(g) removing vapor from the phase separator and passing the vapor through the first heat exchanger to provide cooling of the first withdrawn fraction; and (h) removing liquid from the phase separator as a product stream having a temperature above −112° C. (−170° F.) and a pressure at or above its bubble point pressure.

20. A process for liquefying a pressurized gas stream rich in methane, which comprises the steps of:

(a) withdrawing from the pressured gas stream a first fraction and passing the withdrawn first fraction through a first heat exchanger to cool the first fraction;

(b) withdrawing from the pressured gas stream a second fraction, thereby leaving a third fraction of the pressurized gas stream, and expanding the withdrawn second fraction to a lower pressure to cool the withdrawn second fraction;

(c) cooling the third fraction of the pressurized gas stream in a second heat exchanger by indirect heat exchange with the cooled second fraction;

(d) withdrawing from the cooled third fraction a fourth fraction, thereby leaving a fifth fraction of the pressurized gas stream, and expanding the withdrawn fourth fraction to a lower pressure to cool and at least partially liquefy the withdrawn fourth fraction;

(e) cooling the fifth fraction of the pressurized gas stream in a third heat exchanger by indirect heat exchange with the expanded fourth fraction;

(f) combining the cooled first fraction and the cooled fifth fraction to form a combined stream;

(g) pressure expanding the combined stream to a lower pressure, thereby at least partially liquefying the combined stream, and passing the expanded combined stream to a phase separator which separates vapor produced by the expansion from liquid produced by the expansion;

(h) removing vapor from the phase separator and passing the vapor through the first heat exchanger to provide cooling of the first withdrawn fraction; and (i) removing liquid from the phase separator as a product stream having a temperature above −112° C. (−170° F.) and a pressure at or above its bubble point pressure.

21. The process of claim 20 which further comprises the steps of, after the expanded second fraction cools the third fraction in the second heat exchanger, compressing and cooling the second fraction and thereafter introducing the second fraction to the pressurized gas stream for recycling.

22. The process of claim 20 which further comprises the steps of, after the expanded fourth fraction cools the fifth fraction in the third heat exchanger, passing the fourth fraction through the second heat exchanger, thereafter compressing and cooling the fourth fraction, and then introducing the fourth fraction to the pressurized gas stream for recycling.

23. The process of claim 20 which further comprises the steps of introducing boil-off vapor to the vapor stream withdrawn from the phase separator before the vapor stream is passed through the first heat exchanger.

24. The process of claim 20 wherein the pressurized gas stream has a pressure above 13,790 kPa (2,000 psia).

* * * * *